United States Patent [19]

Perkola

[11] Patent Number: 4,676,440

[45] Date of Patent: Jun. 30, 1987

[54] DISC CUTTER WITH EXHAUST CHANNELS

[75] Inventor: Markku Perkola, Valkeakoski, Finland

[73] Assignee: Yhtyneet Paperitehtaat Oy Jylhavaara, Valkeakoski, Finland

[21] Appl. No.: 788,846

[22] Filed: Oct. 18, 1985

[30] Foreign Application Priority Data

Oct. 19, 1984 [FI] Finland ..... 844123

[51] Int. Cl.[4] ..... B02C 7/12

[52] U.S. Cl. ..... 241/261.3; 241/296

[58] Field of Search ..... 241/28, 261.2, 261.3, 241/296, 297, 298, 244, 245

[56] References Cited

U.S. PATENT DOCUMENTS

| | | | |
|---|---|---|---|
| 2,651,976 | 9/1953 | Sutherland | 241/296 X |
| 3,049,307 | 8/1962 | Dalzell, Jr. | 241/261.3 |
| 3,761,027 | 9/1973 | Mendoza | 241/261.3 |
| 3,910,511 | 10/1975 | Leider et al. | 241/261.3 |

FOREIGN PATENT DOCUMENTS

| | | | |
|---|---|---|---|
| 2083375 | 3/1982 | United Kingdom | 241/261.2 |

*Primary Examiner*—Mark Rosenbaum

*Attorney, Agent, or Firm*—Browdy and Neimark

[57] ABSTRACT

A cutter segment for a disc grinder or the like, said grinder consisting of two oppositely placed cutters made up of several segments attached to each other, at least one of the cutters being rotatable, said cutter segments being provided with a rough surface or with teeth and grooves for the grinding of material such as wood chips. With prior-art grinders of this kind, exhaustion of the steam produced in the grinding process has proved to be a difficult problem. The cutter segment of the invention solves this problem in that the segments of at least one of the cutters are provided with one or more exhaust channels having a sectional area essentially larger than that of the grooves.

7 Claims, 4 Drawing Figures

DISC CUTTER WITH EXHAUST CHANNELS

BACKGROUND OF THE INVENTION

The present invention concerns a cutter segment for a disc grinder or the like, said grinder consisting of two oppositely placed cutters made up of several cutter segments attached to each other, at least one of the cutters being rotatable, said cutter segments being provided with a rough surface or with teeth and grooves for the grinding of material such as wood chips.

To reduce fibrous material such as wood chips to fibers suitable for paper production, a mechanical disc grinder may be used. This defibration process consists in feeding the chips into a grinder, where the material is passed between two grinding cutters placed oppositely. The cutter surfaces are full of grooves and longish protrusions, i.e. teeth, and at least one of the cutters rotates. In this way the material undergoes a very rough treatment between the cutters and is reduced to fibers.

Prior-art cutters, which for ease of manufacture and installation are composed of several segments, have the drawback that the defibrated material contains undefibrated wood particles or splinters, while part of the fibres are over-ground and destroyed. In big grinders operated at considerable power levels, vaporization of the water contained in the wood produces so much steam that, because of the steam pressure, it is difficult to maintain a constant distance between the grinder cutters, which is important in view of product quality. Moreover, the steam bursting out of the grinder in an uncontrolled manner often involves significant trouble in the supply of material into the grinder.

OBJECT OF THE INVENTION

The object of the present invention is to achieve a cutter segment that eliminates the above-mentioned problems and can be manufactured at a moderate cost for industrial use. Thus the cutter segment of the invention is characterized in that the segments of at least one of the cutters are provided with one or more exhaust channels essentially larger in section than the aforesaid grooves. Through these channels the steam is exhausted quickly and in a controlled manner, so that the steam pressure between the cutters cannot rise high enough to impede control of the cutter distance. Also, when the steam is exhausted from the grinder in a controlled fashion, it will not disturb the flow of material into the grinder.

An advantageous embodiment of the invention is characterized in that the exhaust channels serve primarily to exhaust the steam produced in the grinding process, and that the velocity of the steam flowing in the exhaust channel depends on the sectional area of the channel, and that when the velocity of the exhaust steam is over 10 m/s or about 10–50 m/s, the defibrated material is drawn by the steam flow into the exhaust channel and thus removed from the space between the cutters. As the defibrated material is quickly removed by the steam flow, over-grinding of the fibres is prevented, while less energy is consumed in the process.

Another advantageous embodiment of the invention is characterized in that the exhaust channel is placed at an angle to the cutter radius, the most advantageous angle being 30°–60°. With this arrangement, particles larger than a given size that get into the exhaust channel are forced back into the grinding process by the centrifugal force caused by the rotating cutter. As particles larger than fibres are thus returned to the grinding process, no splinters will be left among the defibrated material.

BRIEF DESCRIPTION OF THE DRAWINGS

In the following, the invention is described in detail by the aid of a few examples of its embodiments, reference being made to the drawings attached, wherein.

DESCRIPTION OF THE MOST PREFERRED EMBODIMENTS

Figure 1:
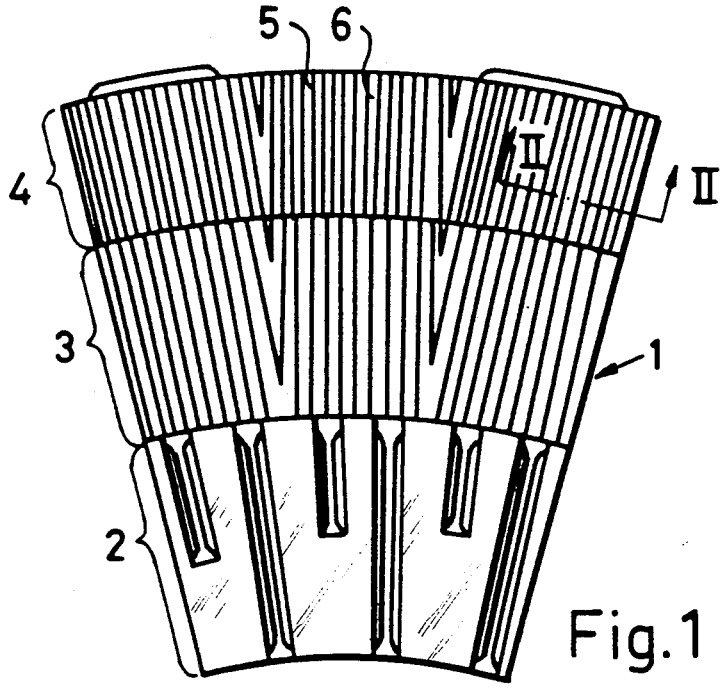
FIG. 1 presents a known cutter segment.
Figure 2:
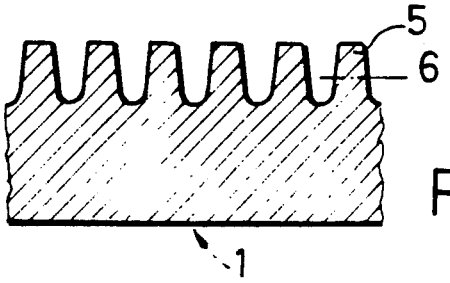
FIG. 2 presents a section through the segment in FIG. 1 along the line II—II.
Figure 3:
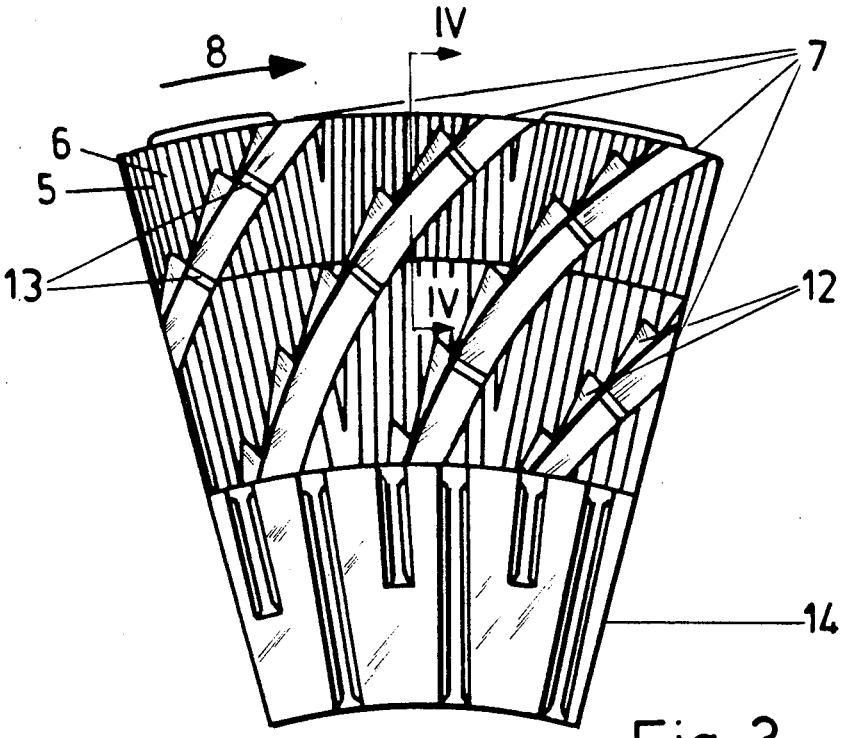
FIG. 3 presents a cutter segment according to the invention.
Figure 4:
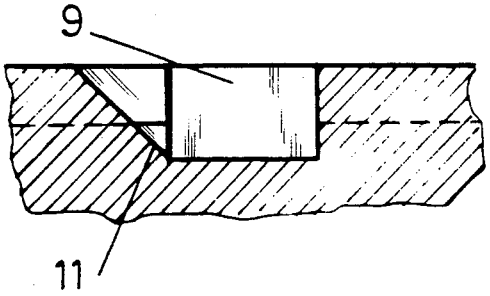
FIG. 4 presents a section through the segment in FIG. 3 along the line IV—IV.

As shown in FIG. 1, a typical prior-art cutter segment is divided into three zones in the direction of material passage. The teeth 5 and grooves 6 in each zone are of a different size, corresponding to the size of the material particles to be ground. The steam produced in the process extrudes from the grinder through the grooves 6 and the very narrow space (about 200 microm.) between the cutters. As the grooves space available during grinding for the steam to escape is very small, this results in the problems referred to above.

In addition to the conventional elements, the cutter segment of the invention comprises exhaust channels 7, which to best advantage are incorporated to in the rotating cutter, called a rotor. In this case the direction of rotation, seen from the cutting side, is as shown by the arrow 8. The sectional area 9 of the exhaust channel 7 is considerably larger than that of a conventional groove 6 between the cutter teeth, which means that the steam is efficiently exhausted through the channel. If the exhaust channel 7 is made to correct dimensions so as to provide an appropriate passage for the amount of steam produced, the violent flow of steam carries the finest material, i.e. the fibers, along with it out of the grinder. The velocity of the steam flow in the channel, according to investigations, should preferably be within 10–50 m/s. If the exhaust channel is placed at a correct angle (30°–60°) to the cutter radius so as to produce a certain impeding effect, the larger particles that have not yet been defibrated are lifted back up from the channel by the mutual effect of the inertia of the particles and the centrifugal force driving them outward in the direction of the cutter radius, to be further ground by the cutter teeth. This arrangement also compensates for the effect of the centrifugal force produced by the rotor cutter that tends to carry the material outwards.

An improved performance is achieved if the outer edge of the exhaust channel 7 is fashioned as an inclined surface 11. Additional edge formations 12 or protrusions 13 at the bottom of the exhaust channel may also be incorporated to control the amount or kind of material that can be carried along by the steam flow.

It is often preferable to have exhaust channels placed only in the outer zones of the cutter segment, leaving the material supply zone 14 without such channels. This is possible because the teeth in the supply zone are large and grooves between them provide sufficient space for the steam even without specific exhaust channels.

It is obvious to a person skilled in the art that the invention is not restricted to the examples of embodiments discussed above, but can instead be varied as specified in the following claims. Thus the invention may as well be applied to e.g. conic grinders.

I claim:

1. A grinder for grinding a material containing a liquid which vaporizes as a result of the grinding, said grinder comprising two cutters having opposing surfaces, and means for rotating one of said cutters around an axis with respect to the other, wherein said opposing surfaces have a plurality of zones distributed radially from said axis, including a first zone and a second zone located adjacent to and outward of said first zone, said first and second zones having respective pluralities of grooves, for successively grinding different sizes of particles of said material, wherein at least a first one of said opposing surfaces has a plurality of exhaust channels, each said exhaust channel extending continuously across said first and second zones and having a cross-section to allow the vaporized liquid to escape along the exhaust channel and to carry said particles therewith, each portion of said exhaust channel being at an angle in the range from 30° to 60° with respect to a line drawn from said axis in said first surface and intersecting the portion, and wherein said exhaust channel is in the shape of an arc with a continuously increasing value of said angle for increasing distance from said axis.

2. The grinder of claim 1, wherein each said arc bends in the direction of the relative rotation of the surface containing the exhaust channel with respect to the other surface.

3. The grinder of claim 1, wherein each said arc bends in a direction opposite the relative rotation of the surface containing it.

4. A grinder of claim 1, comprising first means provided in association with each said exhaust channel for controlling the size of said particles carried along by said vaporized liquid, so that particles smaller than a respective size are preferentially carried along the exhaust channel.

5. The grinder of claim 4, said first means comprising a plurality of protrusions spaced along the bottom of each said exhaust channel.

6. The grinder of claim 4, said first means comprising an edge portion of one side of each exhaust channel being inclined along the exhaust channel, on the side of the exhaust channel toward which said particles being carried by the vaporized liquid are preferentially moved as a result of being carried by said vaporized fluid and said relative rotation.

7. The grinder of claim 4, said grooves of said zones and said cross-section of said exhaust channels being provided for said material being chips of wood to be defibrated between said opposing surfaces, said liquid vaporized from said wood chips comprising water.

* * * * *